United States Patent [19]

Aono et al.

[11] Patent Number: 4,783,392

[45] Date of Patent: Nov. 8, 1988

[54] METHOD FOR FORMING AN DYE TRANSFER IMAGE WITH OIL IN SEPARATING LAYER

[75] Inventors: Toshiaki Aono; Takeshi Shibata; Yasuo Aotsuka; Kazuma Takeno; Masakazu Yoneyama, all of Kanagawa, Japan

[73] Assignee: Fuji Photo Film Co., Ltd., Kanagawa, Japan

[21] Appl. No.: 39,267

[22] Filed: Apr. 17, 1987

[30] Foreign Application Priority Data

Apr. 18, 1986 [JP] Japan ..... 61-89501

[51] Int. Cl.[4] ..... G03C 5/54

[52] U.S. Cl. ..... 430/203; 430/213; 430/215; 430/236; 430/259; 430/262

[58] Field of Search ..... 430/203, 213, 215, 259, 430/262, 212, 236, 631

[56] References Cited

U.S. PATENT DOCUMENTS

| | | | |
|---|---|---|---|
| 3,885,965 | 5/1975 | Hughes et al. | 430/631 |
| 4,004,927 | 1/1977 | Yamamoto et al. | 430/631 |
| 4,500,624 | 2/1984 | Aono et al. | 430/203 |
| 4,665,005 | 5/1987 | Aono et al. | 430/203 |
| 4,693,954 | 9/1987 | Naito | 430/203 |
| 4,696,887 | 9/1987 | Sato et al. | 430/203 |
| 4,704,344 | 11/1987 | Aono et al. | 430/203 |

*Primary Examiner*—Richard L. Schilling

*Attorney, Agent, or Firm*—Sughrue, Mion, Zinn, Macpeak, and Seas

[57] ABSTRACT

A method for forming an image is described, comprising developing a photosensitive element which comprises a support provided thereon a photosensitive layer containing at least a photosensitive silver halide, a binder, and a dye providing substance which forms or releases a diffusible dye by developing after or simultaneously with imagewise exposure thereof, transferring the thus-formed or released diffusible dye to a dye fixing layer of a dye fixing element, and thereafter separating said photosensitive element and said dye fixing element from each other, wherein at least one layer constituting said photosensitive element and said dye fixing element contains an oil component.

18 Claims, No Drawings

METHOD FOR FORMING AN DYE TRANSFER IMAGE WITH OIL IN SEPARATING LAYER

FIELD OF THE INVENTION

The present invention relates to a method for forming an image, and particularly to a method for forming an image where the peelability between a photosensitive element and a dye fixing element after heat development and dye transfer is improved.

BACKGROUND OF THE INVENTION

Silver halide color photosensitive materials are known in this field of art, and the color diffusion transfer method which comprises producing or releasing imagewise a diffusible dye, and then diffusion transferring the same to a dye fixing material (an image receiving material) is also known in this field of art.

With respect to methods for obtaining color images by heat development, many methods have been suggested. With respect to methods for obtaining color images by joining an oxidation product of a developer with a coupler, p-phenylenediamine reducing agents and phenolic or active methylene couplers are suggested in U.S. Pat. No. 3,531,286, p-aminophenol type reducing agents are suggested in U.S. Pat. No. 3,761,270, sulfonamidophenol type reducing agents are suggested in Belgian Patent No. 802,519 and *Research Disclosure* (September 1975), pages 31 and 32 and combination of sulfonamidophenol type reducing agents and 4-equivalent couplers are suggested in U.S. Pat. No. 4,021,240.

However, these methods have the drawback that since an image of reduced silver and a color image are produced simultaneously in the exposed part after heat development, the color image becomes turbid.

To overcome the drawback, a method has been suggested wherein the silver image is removed by liquid treatment or a method has been suggested wherein only the dye is transferred to another layer such as a sheet having an image receiving layer, but these methods have the drawback that it is difficult to transfer only the dye, i.e., separately from unreacted substances.

Further, in the above methods, generally the time required for the development is relatively long, and disadvantageously the image obtained is undesirably high in fog and low in density.

To obviate these drawbacks, there have been suggested a method wherein a mobile dye is released imagewise by heating, and the mobile dye is transferred to a dye fixing element having a mordant by a solvent such as water, a method where the dye is transferred to a dye fixing element by a high boiling point organic solvent, a method wherein the dye is transferred by a hydrophilic thermal solvent contained in a dye fixing element, a method wherein the mobile dye is heat-diffusible or sublimable and is transferred to a dye receiving material such as a support, and other methods (see U.S. Pat. Nos. 4,463,079, 4,474,867, 4,478,927, 4,507,380, 4,500,626 and 4,483,914, Japanese Patent Application (OPI) Nos. 149046/83, 149047/83, 152440/84, 154445/84, 165054/84, 180548/84, 168439/84, 174832/84, 174833/84, 174834/84 and 174835/84, etc., (the term "OPI" as used herein refers to a "published unexamined Japanese patent application").

Methods wherein heat development is carried out in the presence of a small amount of water, and the released dye is transferred so that the development may be promoted, the temperature of the development may be lowered and the treatment may be simplified are disclosed in Japanese Patent Application (OPI) Nos. 218443/84 and 238056/86. In these methods, although a base is contained in a dye fixing element, since the film quality tends to be deteriorated and there is a safety problem, a method disclosed in European Patent Application No. 210,660A uses a complex formation reaction to give off a base.

In these image forming methods, it is required that after the dye is moved, the photosensitive element and the dye fixing element have to be separated (peeled). Therefore, the quality of the surface of the dye fixing element should be such that the surface of the dye fixing element can be brought into firm contact with the photosensitive element to such a degree to allow sufficient migration of the mobile dye, the migration of the dye should not be hampered, the separation, that is, peeling after the transfer, can be made smoothly, and the surface of the dye fixing element should not be roughened when the peeling is effected.

As one means for allowing the peeling to be effected smoothly, there is a method of increasing the hardness of the coated film of the photosensitive element and/or the dye fixing element. However, although smoothness of peeling can be improved to a some extent by this method, there is a problem in that the diffusion of a dye is hampered and the transfer is inefficiently made.

In the case as described, for example, in U.S. Pat. No. 4,500,626, Japanese Patent Application (OPI) Nos. 218443/84 and 238056/86 where small amount of water is supplied to the photosensitive element and/or the dye fixing element, and heat development is carried out or the dye is transferred by heating, particularly the photosensitive element and the dye fixing element are liable to adhere and the peeling becomes difficult, and in this case if the hardness of the coated film is increased, it takes a longer period of time for the supplied water to penetrate the coated film completely, and as a result the process of image formation cannot be made in a short period of time. Furthermore, if the photosensitive element or the dye fixing element is fed and conveyed as a sheet, troubles such as malfunction of feeding and conveyance due to insufficient slip or jamming trouble under high humidity conditions occur.

SUMMARY OF THE INVENTION

Therefore, objects of the present invention include providing a method for forming an image wherein after a photosensitive element and a dye fixing element are brought into contact with each other followed by transferring of dye image, the peelability is improved, and the surface of the coated layer of the part containing the dye fixing element is not roughened after the peeling, and a method for simply obtaining a color image excellent in image quality and image plane without deteriorating the transfer property of a dye.

Another object of the present invention is to provide a method for forming an image wherein water can be absorbed to a photosensitive element and/or a dye fixing element in a short period of time, and the peelability between the photosensitive element and the dye fixing element after the development and the transfer of the dye is improved.

Still another object of the present invention is to improve the feeding and conveying properties of a photosensitive element or a dye fixing element.

These and other objects of the present invention are attained by a method for forming an image comprising developing a photosensitive element which comprises a support provided thereon a photosensitive layer containing at least a photosensitive silver halide, a binder, and a dye providing substance which forms or releases a diffusible dye by developing after or simultaneously with imagewise exposure thereof, transferring the thus formed or released diffusible dye to a dye fixing layer of a dye fixing element, and thereafter separating the photosensitive element and the dye fixing element from each other, wherein at least one layer constituting the photosensitive element and the dye fixing element contains an oil component.

DETAILED DESCRIPTION OF THE INVENTION

The present invention is described in more detail below.

In the present method for forming an image, a photosensitive element is developed, and the dye formed or released is transferred to a dye fixing layer of a dye fixing element.

The photosensitive element and the dye fixing element used in the present invention may be provided, respectively, on separate supports, or may be provided on the same support. Preferably, the layer that contains an oil component is at least one of non-photosensitive layers that are present between the dye fixing layer and the photosensitive layer when the transfer is carried out and that constitute a surface layer after the photosensitive element and the dye fixing element are separated.

Examples of such non-photosensitive layers which are present between the dye fixing layer and the photosensitive layer when the transfer is carried out and which constitute a surface layer after the photosensitive element and the dye fixing element are separated include a surface protective layer of the photosensitive element and/or a surface protective layer of the dye fixing element when the photosensitive element and the dye fixing element are applied respectively to separate supports, or a peeling layer that will be present between the photosensitive layer and the dye fixing layer when the photosensitive element and the dye fixing element are provided on the same support.

The surface protective layer of the photosensitive element and the surface protective layer of the dye fixing element each may comprise one or more layers. If the protective layer comprises two or more layers, the oil component is preferably contained at least in the uppermost layer of the protective layers.

Preferably, the oil component is contained in the protective layer of the dye fixing element or the peeling layer of the dye fixing element. The effect will be great when the photosensitive element and the dye fixing element are provided on separate supports, respectively.

The oil component used in the present invention is preferably a high boiling point organic solvent having a boiling point of 140° C. or higher. Examples thereof include high boiling point organic solvents known in the field of photography such as esters (e.g., phthalic acid esters, phosphoric acid esters, fatty acid esters, etc.), amides (e.g., fatty acid amides, sulfonamides, etc.), ethers, alcohols, paraffins, etc., described, for example, in U.S. Pat. Nos. 2,322,027, 2,533,514 and 2,882,157, Japanese Patent Publication No. 23233/71, British Patent Nos. 958,441 and 1,222,753, Japanese Patent Application (OPI) No. 82078/75, U.S. Pat. Nos. 2,353,262, 3,676,142 and 3,600,454, Japanese Patent Application (OPI) Nos. 27921/76, 141623/76, 178455/84, 178451/84, 17452/84, 178457/84, 178453/84 and 178454/84, etc.

Particularly preferably, in the present invention, use is made of silicone type oil components, described, for example, in U.S. Pat. No. 3,042,522, British patent No. 955,061, U.S. Pat. Nos. 3,080,317, 4,004,927, 4,047,958 and 3,489,567, British patent No. 1,143,118, Japanese patent application (OPI) No. 140341/85, etc.

Particularly preferable oil components in the present invention are silicone oils, including dimethyl silicone oils, modified silicone oils obtained by introducing various organic groups into dimethyl siloxanes, etc.

Representative examples of silicone oils used in the present invention are represented by formula (I) below, which, however, does not restrict the present invention.

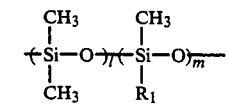

(I)

Compound represented by formula (I) has siloxane units represented by formula (I-1) and end groups represented by formula (I-2).

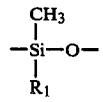

(I-1)

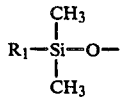

(I-2)

In formula (I), $R_1$ represents a hydrogen atom, a substituted or unsubstituted alkyl group, a cycloalkyl group, a substituted or unsubstituted aryl group, a substituted or unsubstituted alkoxy group, or a substituted or unsubstituted alkoxycarbonyl group; l represents an integer of 0, 1, or more than 1; and m represents an integer of 1 or more, provided that l+m represents an integer of from 1 to 1,000. In formula (I), $R_1$ groups may be the same or different, that is, the silicone oil represented by formula (I) may comprise one kind of siloxane unit represented by formula (I-1) containing one kind of $R_1$ group, or two or more kinds of siloxane units represented by formula (I-1) containing two or more kinds of $R_1$ groups In formula (I), $R_1$ preferably represents a hydrogen atom or an alkyl, substituted alkyl, cycloalkyl, aryl, substituted aryl, alkoxy, substituted alkoxy, alkoxycarbonyl, or substituted alkoxycarbonyl group having from 1 to 20 carbon atoms; and l+m preferably represents an integer of from 2 to 500.

Examples of $R_1$ compounds represented by formula (I) include the following.

$-CH_3$, $-C_5H_{11}$, $-C_8H_{17}$, $-C_{13}H_{27}$, $-C_{14}H_{29}$,

-continued

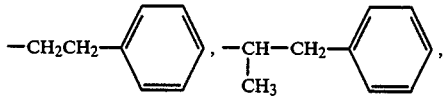

$-(CH_2)_3O(C_2H_4O)_a(C_3H_6O)_bR_2$, $-(CH_2)_3OH$, $-(CH_2)_3NH_2$, $-(CH_2)_3NHCH_2CH_2NH_2$, $-(CH_2)_3OCH-CH_2$ (O), $-(CH_2)_3SH$, $-(CH_2)_3COOH$, $-(CH_2)_6COOH$, $-(CH_2)_{10}COOH$, $-(CH_2)_3CONHR_2$, $-CH_2CH_2CF_3$, $-CH_2CH_2C_6F_{13}$,

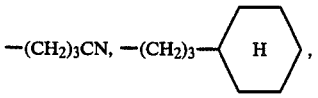

$-(CH_2)_3CN$, $-(CH_2)_3-$ (H),

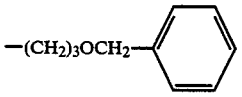

$-(CH_2)_3OCH_2-$, $-(CH_2)_3OR_2$, $-H$, $-OCH_3$,

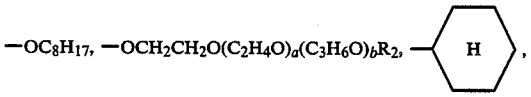

$-OC_8H_{17}$, $-OCH_2CH_2O(C_2H_4O)_a(C_3H_6O)_bR_2$, (H),

-continued

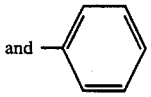

and wherein $R_2$ represents an alkyl group, and a and b each represents 0 or an integer of 1 or more.

The silicone oil represented by formula (I) is preferably represented by formula (II) or (III) below.

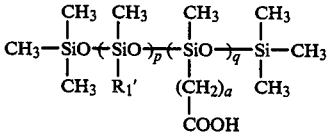

(II)

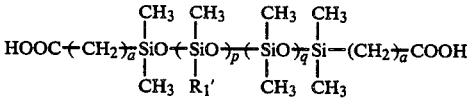

(III)

wherein $R_1'$ represents $-CH_3$ or the same meaning as $R_1$ for formula (I); p represents an integer of 0, 1, or more than 1; q represents an integer of 1 or more; and a represents an integer of from 1 to 17. The silicone oil represented by fomula (II) or (III) preferably has a carboxyl equivalent of from 120 to 6,000, and more preferably from 120 to 4,000.

Representative examples of the compounds represented by formula (I) are indicated below.

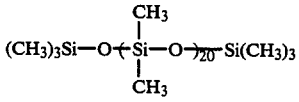

(I-1)

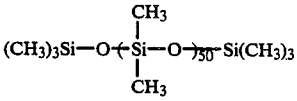

(I-2)

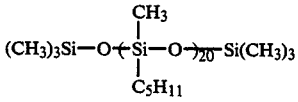

(I-3)

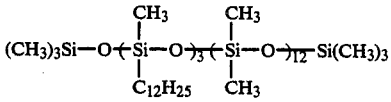

(I-4)

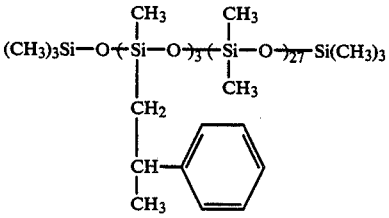

(I-5)

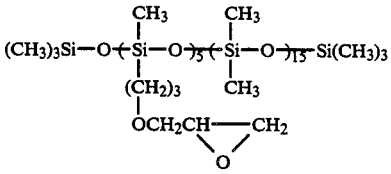

(I-6)

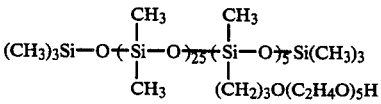

(I-7)

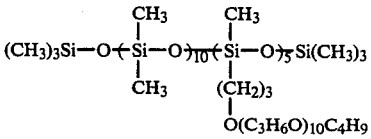

(I-8)

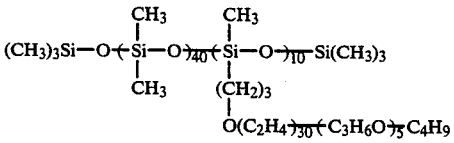

(I-9)

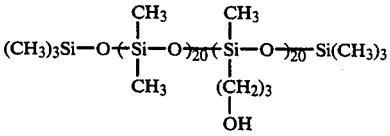

(I-10)

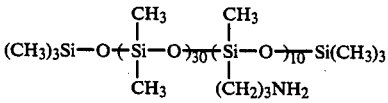

(I-11)

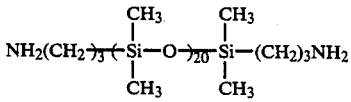

(I-12)

-continued
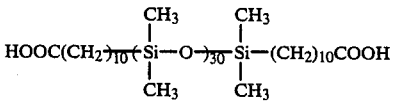
(I-13)
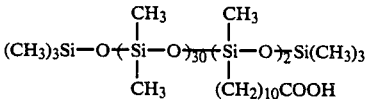
(I-14)
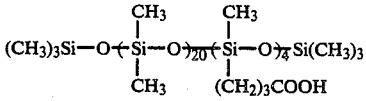
(I-15)
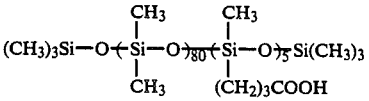
(I-16)
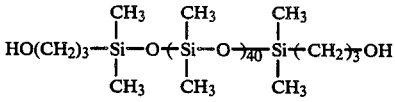
(I-17)
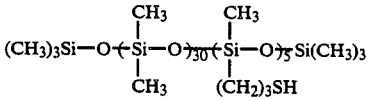
(I-18)
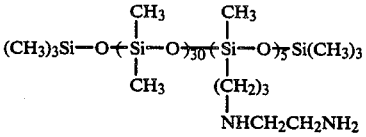
(I-19)
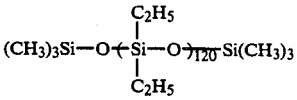
(I-20)
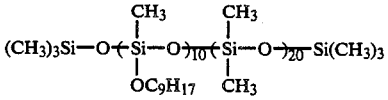
(I-21)
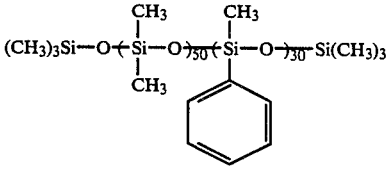
(I-22)
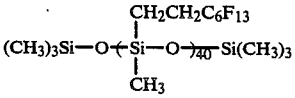
(I-23)
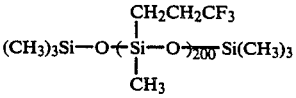
(I-24)
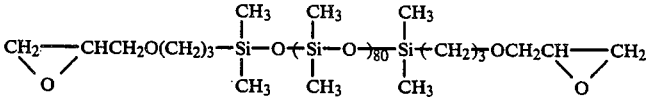
(I-25)
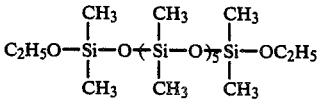
(I-26)
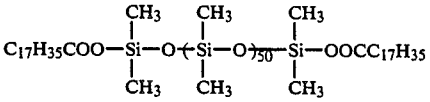
(I-27)
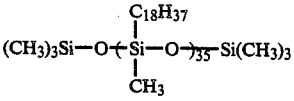
(I-28)
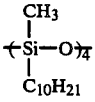
(I-29)
(cyclic)
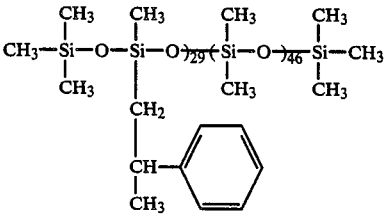
(I-30)
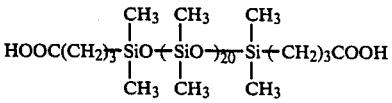
(I-31)
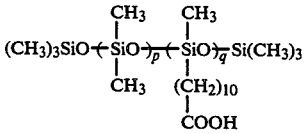
(I-32)~(I-38)
| No. | p | q |
|---|---|---|
| (I-32) | 9 | 1 |
| (I-33) | 20 | 2 |
| (I-34) | 15 | 1 |
| (I-35) | 30 | 3 |
| (I-36) | 40 | 5 |
| (I-37) | 80 | 10 |
| (I-38) | 80 | 2 |

-continued

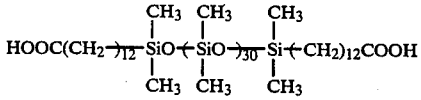

(I-39)

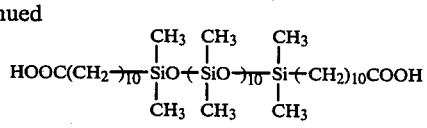

(I-40)

Processes for the production of the compounds represented by formula (I) are known, and are described, for example, in F. G. A. Stone and W. A. G. Graham, *Inorganic Polymers,* (Academic Press, 1962), pages 230 and 231 and 288 to 295; W. Noll, *Chemistry and Technology of Silicones,* (Academic Press, 1968), pages 209 to 211; P. F. Bruind, *Silicone Technology* (A Division of John Wiley and Sons, 1970), pages 64 to 66; J. P. Kennedy et al., *High Polymer,* Vol. 23, Part 2, pages 773 to 775, and others, and particular examples are: a method as described in Japanese Patent Publication No. 22361/61 wherein organosiloxanes are hydrolized; methods as described in Japanese Patent Publication Nos. 10771/60, 28694/68 and 14898/70 wherein addition reactions of olefins to siloxanes containing SiH groups are used; synthetic methods of polyorganosiloxanes containing polyethylene oxides as described in U.S. Pat. No. 2,917,480; *Ind. & Eng. Chem. Prod. Res. & Dev.,* Vol. 6, No. 2, page 88 (1967); *Kagaku to Kogyo* (*Chemistry and Industry*), published by Nihon Kagakukai, Vol. 19, page 147 (1970); British patent No. 916,561; French patent No. 1,353,669; etc.

There is no restriction on the viscosity of the compounds used in the present invention, and although any compound that can be produced by a conventional method has a desired effect, generally it is preferred that the compound has a viscosity of 20 to 100,000 centistokes at 25° C.

Many of silicone oils used in the present invention are commercially available, such as KF410, KF412, KF413, KF351, KF945, KF615, K851, X-22-819, FL100, KF862, KF865, X-22-980, KF100T, X-60-164, X-22-3710, X-22-3715, KF-910, X-22-160B, etc., which are trademarks for products manufactured by Shin-etsu Chemical Co., Ltd.

Although the binder of the non-photosensitive layer used in the present invention may be lipophilic, preferably the binder is hydrophilic. Particularly, in the case where a small amount of water is applied when development is carried out or the dye is transferred, preferably the binder is hydrophilic. Representative examples thereof are proteins such as gelatin and gelatin derivatives, polysaccharides such as cellulose derivatives and starches, natural substances such as gum arabic, dextrins, pullulans, synthetic polymers such as water-soluble polyvinyl compounds including acrylamide polymers, polyvinyl alcohols, polyvinyl pyrrolidones, etc. Among these, gelatin and polyvinyl alcohols are particularly effective.

In the present invention, when the oil component is to be contained in the non-photosensitive layer, and if the binder of the non-photosensitive layer is lipophilic, the oil component may be dissolved in the binder solution. If the binder of the non-photosensitive layer is hydrophilic, typically an oil component, if necessary, is first dissolved in a low boiling point solvent such as methyl acetate, ethyl acetate, butyl propionate, cyclohexanol or the like. Then, the mixture or the oil component itself is added to a solution of the binder of the non-photosensitive layer, using a surface active agent, if necessary, such as an anionic surface active agent, e.g., an alkylbenzenesulfonic acid or alkylnaphthalenesulfonic acid and/or a nonionic surface active agent, e.g., a sorbitan sesquioleate and sorbitan monolaurate, and is emulsified and dispersed using a high speed mixer, a colloid mill, an ultrasonic dispersing apparatus or the like. Thereafter, the resulting dispersion is coated or is added to a coating solution prepared separately followed by coating.

In the present invention, the amount of the oil component to be contained in the non-photosensitive layer is preferably such that the volume ratio thereof to the binder of the non-photosensitive layer is in the range of from 0.005/1 to 1/1, and more preferably from 0.01/1 to 0.4/1. In the present invention when an oil component is used in this ratio, the effect of the improvement in releasability is remarkable, and the oil component does not ooze out to the surface of the nonphotosensitive layer to worsen the gloss of the surface.

In a method for forming a color image in which a diffusible dye is imagewise formed or released, and then the diffusible dye is fixed, the photographic element according to the present invention is used advantageously for fixing the diffusible dye.

Examples of the above method for forming a color image include a color diffusion transfer method in which developing is carried out using a developer solution at room temperature (described, e.g., in Belgian patent No. 757,959), a heat development method in which development is carried out in the substantial absence of water (described, e.g., in European Patent Application No. 76,492A2, Japanese Patent Application (OPI) Nos. 79247/83, 218443/84, 238056/86, etc.), and the like. The photographic element according to the present invention can be applied to any of the above methods.

The present invention is particularly advantageous for applying to a heat development light-sensitive material.

The case where the present invention is applied to a heat development light-sensitive material is illustrated in more detail.

The silver halide that can be used in the present invention can be any one of silver chloride, silver bromide, silver chlorobromide, silver chloroiodide, and silver bromochloroiodide.

Particularly, any one of silver halide emulsions described in U.S. Pat. No. 4,500,626, *Research Disclosure,* RD No. 17029 (June, 1978), pages 9 and 10, Japanese patent application (OPI) No. 107240/86 and U.S. Patent application Ser. No. 917,642 filed on October, 1986, etc., can be used.

The silver halide emulsion used in the present invention may be of the surface latent image type where a latent image is formed mainly on the grain surfaces, or of the internal latent image type where a latent image is formed inside the grains. The silver halide emulsion may be the so-called core-shell emulsion wherein the phase inside the grain is different from the phase of the grain surface layer. In the present invention, a direct reversal emulsion that is a combination of an internal latent image type emulsion and a nucleating agent can be used.

Although a silver halide emulsion can be used without after-ripening, generally it is used after it is chemically sensitized. For emulsions for usual photosensitive elements, known sulfur sensitization, reduction sensitization, noble metal sensitization, etc., can be used alone or in combination. These chemical sensitizations can be carried out in the presence of nitrogen-containing heterocyclic compounds (see Japanese Patent Application (OPI) Nos. 126526/83 and 215644/83).

The amount of the silver halide of the present invention is generally in the range of from 1 mg/m$^2$ to 10 g/m$^2$ in terms of the silver content.

In the present invention, an organic metal salt can be used as an oxidizing agent together with a photosensitive silver halide. In this case, it is required that the photosensitive silver halide and the organic metal salt are in contact with each other or near to each other.

Of such organic metal salts, organic silver salts are particularly preferably used.

Organic compounds that can be used to form such organic silver salt oxidizing agents are compounds described in Japanese Patent Application (OPI) No. 107240/86, U.S. Pat. No. 4,500,626, etc. Silver salts of carboxylic acids having an alkynyl group such as silver phenylpropiolate and silver acetylide described in Japanese Patent Application (OPI) No. 249044/86 are also useful. A combination of two or more organic silver salts can be used.

The organic silver salt are generally used in an amount of from 0.01 to 10 mol, and preferably from 0.01 to 1 mol, per mol of a photosensitive silver halide. The sum of the amounts of a photosensitive silver halide and an organic silver salt which are applied is preferably from 50 mg/m$^2$ to 10 g/m$^2$ in terms of the silver content.

The silver halide used in the present invention may be spectrally sensitized by methine dyes or the like. Dyes that can be used include cyanine dyes, merocyanine dyes, complex cyanine dyes, complex merocyanine dyes, holopolar cyanine dyes, hemicyanine dyes, styryl dyes, and hemioxonol dyes.

Specific examples include sensitizing dyes as described in Japanese Patent Application (OPI) Nos. 180550/84 and 140335/85, *Research Disclosure,* RD No. 17029 (June, 1978), pages 12 and 13, etc., and sensitizing dyes whose color disappears by heating, as described in Japanese Patent Application (OPI) Nos. 111239/85 and 32446/87, etc.

These sensitizing dyes may be used alone or in combination, and a combination of sensitizing dyes is often used particularly for supersensitization.

In addition to a sensitizing dye, a dye that does not have a spectral sensitizing effect itself or a substance that does not substantially absorb visible light, but it exhibits a supersensitizing effect can be incorporated in the emulsion (e.g., as described in U.S. Pat. Nos. 2,933,390, 3,635,721, 3,743,510, 3,615,613, 3,615,641, 3,617,295 and 3,635,721).

These sensitizing dyes may be added to an emulsion before, during, or after chemical sensitization is carried out, or before or after the formation of the nuclei of silver halide grains, according to U.S. Pat. Nos. 4,183,756 and 4,225,666.

The amount of the sensitizing dye used is generally on the order of from $10^{-8}$ to $10^{-2}$ mol per mol of silver halide.

In the present invention, as an image forming substance, a dye providing substance is used, which can form or release a mobile dye corresponding or countercorresponding to the reaction when silver ions are reduced under high temperature conditions.

Examples of dye providing substances that can be used in the present invention include compounds that form dyes by the oxidation coupling reaction (couplers). The couplers may be 4-equivalent couplers or 2-equivalent couplers. 2-Equivalent couplers that have a coupling-off group as a nondiffusible group and form a diffusible dye by the oxidation coupling reaction are preferable. Examples of developers and couplers are described in detail in T. H. James, *The Theory of the Photographic Process,* 4th Edition, pages 291 to 334 and pages 354 to 361, Macmillan et al., 1977, Japanese Patent Application (OPI) Nos. 123533/83, 149046/83, 149047/83, 111148/84, 124399/84, 174835/84, 231539/84, 231540/84, 2950/85, 2951/85, 14242/85, 23474/85 and 66249/85, etc.

Other examples of dye providing substances include compounds that can release or diffuse imagewise diffusible dyes. Compounds of this type can be represented by formula (LI)

$$(\text{Dye-X})_n\text{Y} \qquad \text{(LI)}$$

wherein Dye represents a dye group, a temporarily shortwaved dye group (i.e., having a shifted absorbance) or a dye group precursor, X represents a mere bond or a linking group, Y represents a group that causes the diffusibility of the compound represented by $(\text{Dye-X})_n\text{Y}$ to be differentiated corresponding or countercorresponding to a photosensitive silver salt having a latent image imagewise or a group that can release the Dye, and causes the diffusibility to be differentiated between Dye and $(\text{Dye-X})_n\text{Y}$, n is 1 or 2, and when n is 2, the two Dye-X groups may be the same or different.

Examples of dye providing substances represented by formula (LI) include dye developers wherein a hydroquinone type developer and a dye component are linked as described in U.S. Pat. Nos. 3,134,764, 3,362,819, 3,597,200, 3,544,545, 3,482,972, etc. Substances that release diffusible dyes by an intramolecular nucleophilic substitution reaction are described in U.S. Pat. No. 3,980,479, etc., and substances that release a diffusible dye by the intramolecular rewinding reaction of an isooxazolone ring are described in Japanese Patent Application (OPI) No. 111628/74, etc.

Another example is a system where a dye releasing compound is converted to an oxidized form incapable of releasing a dye, then it is allowed to be present with a reducing agent or its precursor, and after the development it is reduced by the unoxidized remaining reducing agent, thereby releasing a diffusible dye, and examples of dyes thus used are described in Japanese Patent Application (OPI) Nos. 110827/73, 130927/79, 164342/81 and 35533/78. Examples of dye providing substances that release a diffusible dye in the same mechanism include compounds that release a diffusible dye by splitting the N-O bond by the remaining reducing agent.

Nondiffusible compounds described in Japanese Patent Application (OPI) No. 185333/84 can be used that give rise to a donor-acceptor reaction in the presence of a base to release a diffusible dye, but do not release a dye when they react with the oxidation product of a reducing agent (LDA compounds).

In these systems, a diffusible dye is released or diffused at a part where development has not taken place, and a dye is not released or diffused at a part where development has taken place.

As substances that cause a diffusible dye to be released at a part where development has taken place are mentioned materials that are couplers having a diffusible dye as a splittable group and can release a diffusible dye by the reaction with the oxidation product of a reducing agent (DDR couplers), which materials are described in British patent No. 1,330,524, Japanese patent publication No. 39165/73, British patent No. 3,443,940, etc., and are preferably used in the present invention.

In these systems where a reducing agent is used, since stain of an image due to oxidized and decomposed byproducts of the reducing agent cause a serious problem, a dye releasing compound that does not require a reducing agent and has a reducing effect itself (DRR compound) has been devised to obviate the problem, and can be used advantageously in the present invention. Typical examples thereof are dye providing substances described in U.S. Pat. Nos. 3,928,312, 4,053,312, 4,055,428 and 4,336,322, Japanese Patent Application (OPI) Nos. 65839/84, 69839/84, 3819/78 and 104343/76, *Research Disclosure,* RD No. 17465 (October, 1978), U.S. Pat. Nos. 3,728,113 and 3,443,939, Japanese patent application (OPI) Nos. 116537/83 and 179840/82, U.S. Pat. No. 4,500,626, etc. Specific examples of this type of dye providing substance are compounds described in U.S. Pat. No. 4,500,626, and in particular, compounds (1) to (3), (10) to (13), (16) to (19), (28) to (30), (33) to (35), (38) to (40), and (42) to (64) described in U.S. Pat. No. 4,500,626 are preferred. Compounds described in Japanese patent application (OPI) No. 124941/86 are also useful.

Further, as dye providing substances other than those described above, dye silver compounds wherein an organic silver salt is combined with a dye (*Research Disclosure* (May, 1978), pages 54 to 58), azo dyes used in the heat development silver dye bleaching process (*Research Disclosure* (April, 1976), pages 30 to 32), and leuco dyes (U.S. Pat. Nos. 3,985,565 and 4,022,617, etc.) and others can also be used.

Dye providing substances described above and hydrophobic additives such as image formation promoting agents described below can be introduced into the layer of the photosensitive element by a known method, for example, by a method described in U.S. Pat. No. 2,322,027. In this case, a high boiling point organic solvent as described in Japanese Patent Application (OPI) Nos. 83154/84, 178451/84, 178452/84, 178453/84, 178454/84, 178455/84 and 178457/84, etc., can be used, if required, together with a low boiling point organic solvent having a boiling point of from 50° to 160° C.

The amount of the high boiling point organic solvent is up to 10 g, and preferably up to 5 g, per g of dye providing substance.

Methods of dispersion using polymers described in Japanese Patent Publication No. 39853/76 and Japanese Patent Application (OPI) No. 59943/76 can also be used.

If a compound is substantially insoluble in water, as other means than the methods mentioned above the compound can be dispersed as fine particles in the binder.

When a hydrophobic material is to be dispersed in a hydrophilic colloid, various surface active agents can be used. For example, surface active agents described in Japanese Patent Application (OPI) No. 157636/84 can be used.

In the present invention, it is desirable that a reducing substance is contained in the photosensitive element. Reducing substances include, in addition to generally known reducing agents, dye providing substances having a reducing effect as mentioned above. Reducing agent precursors that do not have a reducing effect themselves but exhibit a reducing effect during the development or by the action of a nucleophilic reagent or heat can also be used. Examples of reducing agents used in the present invention include reducing agents described in U.S. Pat. Nos. 4,500,626 and 4,483,914, Japanese Patent Application (OPI) Nos. 140335/85, 128438/85, 128436/85, 128439/85 and 128437/85, etc. Reducing agent precursors described in Japanese Patent Application (OPI) Nos. 138736/81 and 40245/82, U.S. Pat. No. 4,330,617, etc., can also be used.

A combination of various reducing agents as disclosed in U.S. Pat. No. 3,039,869 can be used.

The amount of a reducing agent used in the present invention is generally from 0.01 to 20 mol, and preferably from 0.1 to 10 mol, per mol of silver.

In the present invention, compounds that can activate the development of the photosensitive element and, at the same time, can stabilize the image can also be used. Specific examples of such compounds that are preferably used are described in U.S. Pat. No. 4,500,626.

In the present invention, various antifoggants and photographic stabilizers can be used. Examples thereof include azoles and azaindenes described in *Research Disclosure* (December, 1978), pages 24 and 25, nitrogen-containing carboxylic acids and phosphoric acids described in Japanese Patent Application (OPI) No. 168442/84, mercapto compounds and metal salts thereof described in Japanese Patent Application (OPI) No. 111636/84 and acetylene compounds described in U.S. patent application Ser. No. 917,642 filed on Oct. 10, 1986.

In the present invention, if required, an image toning agent can be contained in the photosensitive element. Specific examples of effective toning agents are compounds described in Japanese Patent Application (OPI) No. 147244/86.

To obtain a wide range of colors in a chromaticity diagram using three primaries, yellow, magenta and cyan, a photosensitive element is used that has at least three silver halide emulsion layers having sensitivities in different spectrum ranges. For example, a combination of a blue-sensitive layer, a green-sensitive layer, and a red-sensitive layer, a combination of a green-sensitive layer, a red-sensitive layer, and an infrared-sensitive layer, and the like can be used. If desired, each of these sensitive layers may be divided into two or more layers.

The photographic element according to the present invention comprises a photosensitive element that can produce or release a dye by heat development and a dye fixing element for fixing the dye.

Representative embodiments of the combination of the photosensitive element and the dye fixing element can be classified roughly into two embodiments: an embodiment wherein the photosensitive element and the dye fixing element are applied on two separate supports respectively, and an embodiment wherein the photosensitive element and the dye fixing element are applied on the same support. For the relationship between the photosensitive element and the dye fixing element, the relationship thereof with the support, and the relationship thereof with the white reflecting layer, the relationships described in Japanese Patent Application (OPI) No. 147244/86 and U.S. Pat. No. 4,500,626 can be applied.

The dye fixing element that can be used preferably in the present invention has at least one layer containing a mordant and a binder. As a mordant, those known in the field of photography can be used, and specific examples are those described in Japanese Patent Application (OPI) No. 88256/86. The dye fixing element is provided, if desired, with auxiliary layer(s) such as a protective layer, a peeling layer, a curl preventing layer, etc. Particularly, it is useful to provide a protective layer. One or more of these layers may contain a hydrophilic thermal solvent, a plasticizer, a discoloration preventing agent, an ultraviolet ray absorber, a slipping agent, a matting agent, an antioxidant, a dispersed vinyl compound for increasing dimensional stability, a highly water-absorbable polymer, a surface active agent, a fluorescent whitening agent, etc. Particularly, in a system where heat development and transfer of the dye are carried out simultaneously in the presence of a small amount of water, it is preferable that the dye fixing element contains a base and/or a base precursor mentioned below to enhance the keeping quality of the photosensitive element. Specific examples of these additives are described in Japanese Patent Application (OPI) No. 88256/86.

In the present invention, the photosensitive element and/or the dye fixing element may contain an image formation promoting agent. The image formation promoting agent has a function, for example, for promoting the redox reaction of a silver salt oxidizing agent and a reducing agent, for promoting the production of a dye from the dye providing substance, for promoting the reaction including, for example, the decomposition of a dye or the release of a diffusible dye, and for promoting the transfer of a dye from the photosensitive element layer to the dye fixing layer. From the point of view of physicochemical functions, the image formation promoting agents can be classified into bases or base precursors, nucleophilic compounds, high boiling point organic solvents (oils), thermal solvents, surface active agents, compounds having an interaction with silver or silver ions, etc. However, these substances generally have a composite function and generally each of them has some of the promoting effects above. Details of the image formation promoting agents are described in Japanese Patent Application (OPI) No. 93451/86.

In addition to the above, there are other methods for generating bases, and any compounds used in these methods are useful as base precursors. Examples thereof include a method as described in European Patent Application No. 210,660A wherein bases are generated by mixing a sparingly soluble metal compound with a compound (that is called a complex forming compound) capable of forming a complex with the metal ion constituting the sparingly soluble metal compound and a method as described in Japanese Patent Application (OPI) No. 232451/86 wherein bases are generated by electrolysis.

Particularly, the former method is effective. The sparingly soluble metal compounds include carbonates, hydroxides, oxides, or the like of zinc, aluminum, calcium, barium or the like. With respect to the complex forming compounds, details are described, for example, in A. E. Martell and R. M. Smith, *Critical Stability Constants,* Volumes 4 and 5 (Plenum Press).

Specifically, salts of quaternary ammonium salts, guanidines, amidines or alkali metals with aminocarboxylic acids, imidinoacetic acids, pyridylcarboxylic acids, aminophosphoric acids, carboxylic acids (e.g., mono-, di-, tri-, and tetracarboxylic acids, and compounds having a substituent such as a phosphono, hydroxy, oxo, ester, amido, alkoxy, mercapto, alkylthio, and phosphino group), hydroxamic acids, polyacrylates, and polyphosphoric acids can be used.

Advantageously, the sparingly soluble metal compound and the complex forming compound are added separately to the photosensitive element and the dye fixing element.

In the present photosensitive element and/or the dye fixing element, various development stopping agents can be used to obtain a definite image at all times despite variations of treating temperature and treating time at the time of development.

Herein, the term "development stopping agent" means compounds that, after suitable development, neutralizes the base or reacts with the base quickly to lower the concentration of the base in the film to stop the development, or interacts with the silver and the silver salt to suppress the development. Specific examples thereof include acid precursors that release an acid upon heating, electrophilic compounds that give rise to a substitution reaction with the coexisting base upon heating, nitrogen-containing heterocyclic compounds, mercapto compounds and their precursors, etc. (e.g., compounds described in Japanese Patent Application (OPI) Nos. 108837/85, 192939/85, 230133/85 and 230134/85.

Compounds that release mercapto compounds upon heating are also useful, such as compounds described in Japanese Patent Application (OPI) Nos. 67851/86, 147244/86, 124941/86, 185743/86, 182039/86, 185744/86, 184539/86, 188540/86 and 53632/86.

As the binder for the present photosensitive element and/or the dye fixing element, hydrophilic binders can be used. The hydrophilic binders include transparent or semitransparent hydrophilic binders including, for example, natural substances such as proteins, e.g., gelatin, gelatin derivatives, polysaccharides, e.g., cellulose derivatives, starches, gum arabic, and synthetic polymers, e.g., water-soluble polyvinyl compounds, for example, polyvinyl pyrrolidone acrylamide polymers, or the like. Dispersed vinyl compounds for increasing the dimensional stability of photographic elements can be used in the form of a latex. These binders can be used alone or in combination.

In the present invention, the binder is generally applied in an amount of up to 20 g, preferably up to 10 g, and more preferably up to 7 g, per $m^2$.

The amount of the high boiling point organic solvent that is dispersed together with a hydrophobic compound such as a dye providing substance is generally up to 1 cc, preferably up to 0.5 cc, and more preferably up to 0.3 cc, per g of the binder.

The layers (such as photographic emulsion layers and a dye fixing layer) constituting the present photosensitive element and/or the dye fixing element may contain inorganic or organic hardening agents.

Specific examples of hardening agents include those described in Japanese Patent Application (OPI) Nos. 147244/86 and 157636/84, and these can be used alone or in combination.

If a slight amount of water is applied to the photosensitive element or the dye fixing element when heat development or transfer of the dye is carried out so that the heat development may be promoted or the transfer of the dye may be quickened, it is preferable that the hardness of the film of the photographic element to which the water is applied is kept below a certain value to shorten the time required for the water to penetrate completely into the applied film. In this case, it is preferable that the hardening agent is contained in an amount of up to 10 wt %, particularly from 1 to 10 wt %, for the total amount of binders crosslinkable with the hardening agent. When a hardening agent is used in an amount in this range, the peelability can be improved to some extent, the peelability can be further improved by means of the present invention.

To promote the migration (transfer) of a dye, a hydrophilic thermal solvent that is a solid at an ordinary temperature but which melts at high temperatures may be contained in the photosensitive element or the dye fixing element. The hydrophilic thermal solvent may be contained in either the photosensitive element or the dye fixing element, or may be contained in both of them. Although the layer in which the hydrophilic thermal solvent is contained may be any of an emulsion layer, an intermediate layer, a protective layer, and a dye fixing layer, preferably it is contained in a dye fixing layer and/or a layer adjacent thereto. Examples of the hydrophilic thermal solvents include ureas, pyridines, amides, sulfonamides, imides, alnyls, oximes, and other heterocyclic compounds. Further, to promote the migration of the dye, a high boiling point organic solvent may be contained in the photosensitive element and/or the dye fixing element.

The support used for the present photosensitive element and/or the dye fixing element is to be one that can withstand the treating temperature. As a usual support can be used a support of glass, paper, polymer film, metal or materials similar thereto, and also supports described in Japanese Patent Application (OPI) No. 147244/86.

The photosensitive element and/or the dye fixing element may have an electrically conductive heat generating layer that can act as heating means for the diffusion transfer of the dye.

In this case, the transparent or semitransparent heat generating element can be a resistance heat generating layer made by known manner. To make a resistance heat generating layer, there is a method that uses a thin film of a semiconductive organic material, and a method that uses an organic thin film wherein electrically conductive fine particles are dispersed in a binder. Materials that can be used in these methods are those described, e.g., in Japanese Patent Application (OPI) No. 29835/86, etc.

In the present invention, as the method for applying the heat development photosensitive layer, the protective layer, the intermediate layer, the primary coat layer, the backing layer, the dye fixing layer, and other layers can be used those methods described in U.S. Pat. No. 4,500,626.

As a light source for imagewise exposure for recording an image on the photosensitive element can be used radiation including visible light. Generally, a light source usually used in color printing can be used, for example, a tungsten lamp, a mercury lamp, a halogen lamp such as an iodine lamp, a xenon lamp, a laser beam, a CRT (cathode ray tube) light source, a light emission diode (LED), and light sources as described in Japanese Patent Application (OPI) No. 147244/86 and U.S. Pat. No. 4,500,626.

In the present invention, steps of heat development and transfer of the dye may be separated or may be simultaneously carried out. They may be continuous in that heat development is followed by transfer of the dye in one continuous step.

For example, (1) a method where the photosensitive element is exposed imagewise, and is heated, the dye fixing element is placed thereon, and, if required, is heated to transfer the mobile dye to the dye fixing element, and (2) a method where the photosensitive element is exposed imagewise and the dye fixing element is placed thereon followed by heating can be used. The methods (1) and (2) can be carried out substantially in the absence of water, or can be carried out in the presence of a slight amount of water.

Although the heating temperature for the heat development step can be from about 50° C. to about 250° C., it is preferable that the heating temperature is from about 80° C. to about 180° C. If the heating is carried out in the presence of a slight amount of water, the upper limit of the heating temperature is up to the boiling point. When the transfer step is carried out after the completion of the heat development, the heating temperature for the transfer step may be in the range between the temperature for the heat development step and room temperature, with a temperature down to 50° C., but at least 10° C. lower than the temperature for the heat development step being preferred.

In the present invention, a preferred method for forming an image includes heating the photosensitive element in the presence of a slight amount of water and a base and/or a base precursor after imagewise exposure or simultaneously with imagewise exposure thereby transferring the diffusible dye that has been produced at a part corresponding or countercorresponding to the silver image to the dye fixing layer simultaneously with the development. According to this method, since the production or the release reaction of the diffusible dye proceeds quite fast, and the migration of the diffusible dye to the dye fixing layer proceeds fast, a high density color image can be obtained in a short period of time.

In this mode, water may be used in such a small amount that the amount is at least 0.1 times the total weight of the total applied layers of the photosensitive element and the dye fixing element, and preferably from 0.1 times to the weight of the solvent corresponding to the maximum swelling volume of the total applied layers (particularly the amount obtained by substracting the weight of the total layers from the weight of the solvent corresponding to the maximum swelling volume of the total layers).

Since the state of the film when it has swollen is unstable and there is a possibility of local oozing under some conditions, it is preferable that to obviate this the amount of water is up to the amount corresponding to the volume of the total applied layers of the photosensitive element and the dye fixing element at the time of maximum swelling. Particularly, the amount of water is generally from 1 to 50 g, preferably from 2 to 35 g, and more preferably from 3 to 25 g, per square meter of the total area of the photosensitive element and the dye fixing element.

Also in this mode, a base and/or a base precursor can be contained in the photosensitive element and the dye fixing element, and can be supplied by dissolving it in water.

In this mode, it is preferable that as a base precursor a water sparingly soluble basic metal compound and a compound that can react with the metal ion constituting the water sparingly soluble basic metal compound to form a complex using water as a medium are contained in the image forming reaction region so that the pH of the system is raised by the reaction of these two compounds when heated. Herein, the term "image reaction region" means the region where the image forming reaction takes place. Specifically, as the region can be mentioned the layer belonging to both the photosensitive element and the dye fixing element. If there are two or more layers, any of the layers may become the region.

The sparingly soluble metal compound and the complex forming compound are required to be added at least separately to layers so as to prevent them from reacting until the development treatment. For example, in the case of the so-called monosheet material having the photosensitive element and the dye fixing element on the same support, it is preferable that the compounds are added to separate layers and one or more layers are placed between the separate layers. In a more preferred mode, the sparingly soluble metal compound and the complex forming compound are contained in respective layers placed on respective separate supports. For example, it is preferable that the sparingly soluble metal compound is contained in the photosensitive element and the complex forming compound is contained in the dye fixing element having a support different from that of the photosensitive element. The complex forming compound may be supplied by dissolving in water that coexists therewith. It is desirable that the sparingly soluble metal compound is contained as a dispersion of finely divided particles prepared by the methods described, for example, in Japanese Patent Application (OPI) Nos. 174830/81 and 102733/78, etc., and preferably the average grain size is up to 50 μm, more preferably up to 5 μm. The sparingly soluble metal compound may be added to any layer of a photosensitive layer, an intermediate layer, a protective layer or the like of the photosensitive layer, and may be added to two or more layers.

When the sparingly soluble metal compound and the complex forming compound is contained in a layer on a support, the amount thereof depends on the type of the compound, the particle size of the sparingly soluble metal compound, the complex forming reaction rate, etc., and it is preferable that the amount of each is up to 50 wt %, more preferably from 0.01 to 40 wt %, based on the weight of the applied layers. When the complex forming compound is supplied by dissolving it in water, preferably the concentration is from 0.005 mol to 5 mol, more preferably from 0.05 mol to 2 mol, per liter. In the present invention, the molar ratio of the content of the complex forming compound to the content of the sparingly soluble compound in the reaction system is generally from 0.01/1 to 100/1, and preferably from 0.1/1 to 20/1.

As a method for supplying water to the photosensitive layer or the dye fixing layer can be mentioned, for example, the method described in Japanese Patent Application (OPI) No. 147244/86. As heating means in the development step and/or the transfer step can be mentioned means such as a hot plate, an iron, a hot roller, etc., described in Japanese Patent Application (OPI) No. 147244/86. It is also possible that a layer of an electrically conductive material such as graphite, carbon black, metal, etc., is placed on the photosensitive element and/or the dye fixing element, and an electric current is passed to the conductive layer to heat directly the element.

As the method where the photosensitive element and the dye fixing element are superimposed together and brought in firm contact with each other under certain conditions, and a pressure is applied thereto can be mentioned the method described in Japanese Patent Application (OPI) No. 147244/86.

In the process and the photographic element according to the present invention, any of various heat developing apparatuses can be used. For example, the apparatuses described in Japanese Patent Application (OPI) Nos. 75247/84, 177547/84, 181353/84 and 18951/85, etc., are preferably used.

After completion of the heat development and the transfer of the dye, the photosensitive element is peeled apart from the dye fixing element, which can be quite readily carried out according to the present invention. The peeling may be manually carried out by hands or may be carried out by means of machines known from Japanese Patent Publication Nos. 5474/67, 5676/66, 1354/70 and 29713/78, Japanese Patent Application (OPI) No. 135944/85, etc.

The present invention is described in more detail with reference to the following examples, but is not limited thereto

EXAMPLE 1

A benzotriazole silver emulsion was prepared as follows.

20 g of gelatin and 13.2 g of benzotriazole were dissolved in 300 ml of water. This solution was maintained at 40° C. while stirring. A solution of 17 g of silver nitrate in 100 ml of water was added to this solution over 2 minutes.

The pH of this benzotriazole silver emulsion was adjusted to precipitate and remove the excess salt. Thereafter, the pH was adjusted to 6.3 to yield 400 g of benzotriazole silver emulsion.

A silver halide emulsion for a fifth layer and a first layer was prepared as follows.

600 g of an aqueous solution containing 17 g of sodium chloride and 35 g of potassium bromide and an aqueous silver nitrate solution (containing 0.59 mol of silver nitrate in 600 m of water) were added at the same time at the same flow rate over 40 minutes to an aqueous gelatin solution containing 20 g of gelatin and 3 g of sodium chloride in 1,000 ml of water maintained at 75° C. while stirring. Thus, a monodispersed cubic silver chlorobromide emulsion (bromide: 50 mol %) having an average grain size of 0.40 μm was prepared.

After washing, and desalting, 5 mg of sodium thiosulfate and 20 mg of 4-hydroxy-6-methyl-1,3,3a,7-tetraazaindene were added to the emulsion followed by chemical sensitization at 60° C. The yield of the emulsion was 600 g.

A silver halide emulsion for a third layer was prepared as follows.

600 ml of an aqueous solution containing 7 g of sodium chloride and 56 g of potassium bromide and an aqueous silver nitrate solution (containing 0.59 mol of silver nitrate in 600 ml of water) were added at the same time at the same flow rate over 40 minutes to an aqueous gelatin solution containing 20 g of gelatin and 3 g of sodium chloride in 1,000 ml of water maintained at 75° C. while stirring. Thus, a monodispersed cubic silver chlorobromide emulsion (bromide: 80 mol %) having an average grain size of 0.35 μm was prepared.

After washing and desalting, 5 mg of sodium thiosulfate and 20 mg of 4-hydroxy-6-methyl-1,3,3a,7-tetraazaindene were added to the emulsion followed by chemical sensitization at 60° C. The yield of the emulsion was 600 g.

A gelatin dispersion of a dye providing substance was prepared as follows.

5 g of Yellow Dye Providing Substance (A), 0.5 g of succinic acid-2-ethylhexyl ester sulfonic acid sodium as a surface active agent, and 10 g of triisononyl phosphate as a high boiling point solvent were weighed, 30 ml of ethyl acetate was added thereto, and they were heated to about 60° C. to be dissolved to obtain a uniform solution. After this solution was mixed and stirred with 30 g of a 10% lime-processed gelatin solution, it was dispersed for 10 minutes at 10,000 rpm by a homogenizer. This dispersion is called a dispersion of the yellow dye providing substance hereinafter.

In the same manner as above except that Magenta Dye Providing Substance (B) and 7.5 g of tricresyl phosphate as a high boiling point solvert were used, a dispersion of a magenta dye providing substance was prepared.

A cyan dye providing substance dispersion was prepared in the same manner as for the yellow dye dispersion except that Cyan Dye Providing Substance (C) is used.

Using the above dispersions, color Photosensitive Element 101 having the multilayer construction as shown in the following was prepared. In this Photosensitive Element 101, the total amount of a hardening agent was 2 wt % of the total amount of gelatin.

Photosensitive Elements 102 to 105 were prepared in the same manner as for Photosensitive Element 101, except that instead of the aqueous gelatin solution for the sixth layer, oil dispersions were used that are shown below for the preparation of dye fixing elements. With respect to the components other than the oil droplets (the type and the amount are given in Table 1), i.e., the hardening agent, the silica, and the surface active agent, the composition of the sixth layer of these photosensitive elements was the same as that in the sixth layer of Photosensitive Element 101.

| | Coated Amount |
|---|---|
| Sixth Layer | |
| Gelatin | 800 mg/m$^2$ |
| Hardener*3 | 47 mg/m$^2$ |
| Silica*5 | 100 mg/m$^2$ |
| Surface Active Agent*2 | 120 mg/m$^2$ |
| Fifth Layer: Green-Sensitive Emulsion Layer | |
| Silver Chlorobromide Emulsion | 400 mg/m$^2$ (as silver) |
| (bromide: 50 mol %) | |
| Silver Benzotriazole Emulsion | 100 mg/m$^2$ (as silver) |
| Sensitizing Dye D-1 | $10^{-6}$ mol/m$^2$ |
| Hardener*3 | 96 mg/m$^2$ |
| Yellow Dye Providing Substance (A) | 400 mg/m$^2$ |
| Gelatin | 1,000 mg/m$^2$ |
| High Boiling Solvent*4 | 800 mg/m$^2$ |
| Surface Active Agent*2 | 100 mg/m$^2$ |
| Fourth Layer: Intermediate Layer | |
| Gelatin | 900 mg/m$^2$ |
| Hardener*3 | 33 mg/m$^2$ |
| Zinc Hydroxide | 500 mg/m$^2$ |
| Third Layer: Red-Sensitive Emulsion Layer | |
| Silver Chlorobromide Emulsion | 300 mg/m$^2$ |

-continued

| | |
|---|---|
| | (as silver) |
| (bromide: 80 mol %) | |
| Silver Benzotriazole Emulsion | 100 mg/m$^2$ (as silver) |
| Sensitizing Dye D-2 | $8 \times 10^{-7}$ mol/m$^2$ |
| Hardener*3 | 108 mg/m$^2$ |
| Magenta Dye providing Substance (B) | 400 mg/m$^2$ |
| Gelatin | 1,000 mg/m$^2$ |
| High Boiling Solvent*1 | 600 mg/m$^2$ |
| Surface Active Agent*2 | 100 mg/m$^2$ |
| Second Layer: Intermediate Layer | |
| Gelatin | 800 mg/m$^2$ |
| Hardener*3 | 33 mg/m$^2$ |
| Zinc Hydroxide | 500 mg/m$^2$ |
| First Layer: Infrared Light-Sensitive Emulsion Layer | |
| Silver Chlorobromide Emulsion | 300 mg/m$^2$ (as silver) |
| (bromide: 50 mol %) | |
| Silver Benzotriazole Emulsion | 100 mg/m$^2$ (as silver) |
| Sensitizing Dye D-3 | $10^{-8}$ mol/m$^2$ |
| Hardener*3 | 96 mg/m$^2$ |
| Cyan Dye Providing Substance (C) | 300 mg/m$^2$ |
| Gelatin | 1,000 mg/m$^2$ |
| High Boiling Solvent*4 | 600 mg/m$^2$ |
| Surface Active Agent*2 | 100 mg/m$^2$ |
| Support | |

*1Tricresyl Phosphate

*2 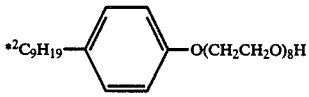

*31,2-Bis(vinylsulfonylacetamido)ethane

*4$(iso\text{-}C_9H_{19}O)_3P{=}O$

*5Size: 4 μm

Yellow Dye Providing Substance (A):

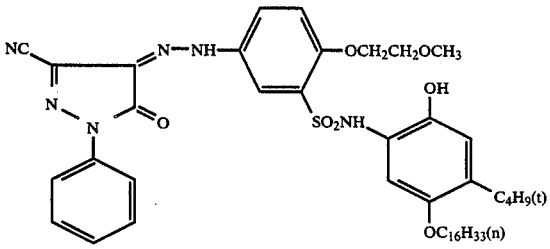

Magenta Dye Providing Substance (B):

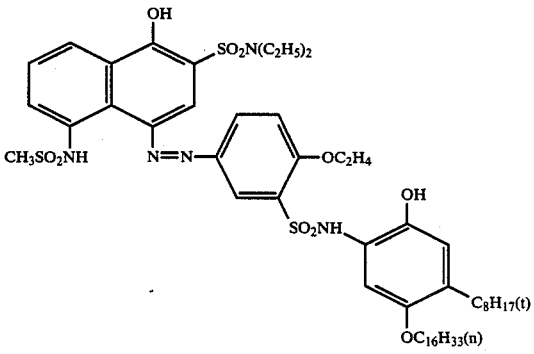

-continued

Cyan Dye Providing Substance (C):

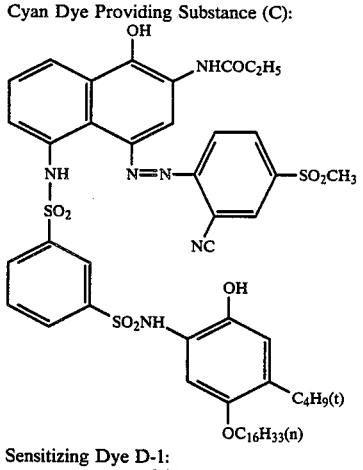

Sensitizing Dye D-1:

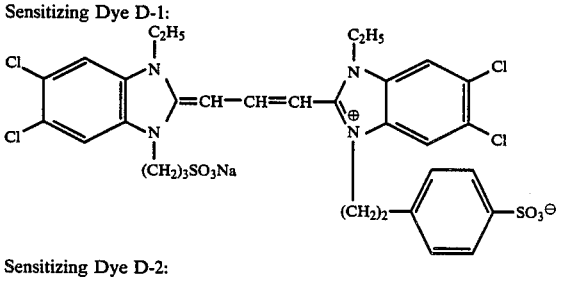

Sensitizing Dye D-2:

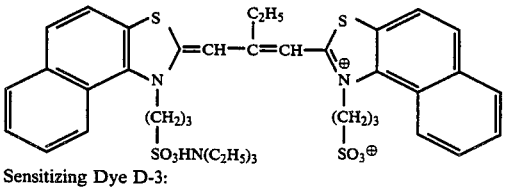

Sensitizing Dye D-3:

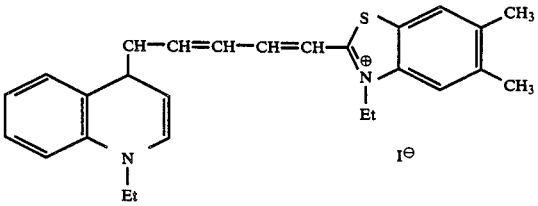

Dye fixing elements were prepared as follows.

63 g of gelatin, 130 g of a mordant having the following structure:

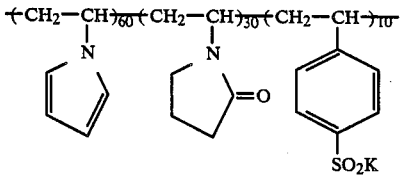

and 80 g of picolinic acid guanidinium salt were dissolved in 1,300 ml of water and was applied on a paper support laminated with apolyethylene to have a wet thichness of 42 μm followed by drying.

A solution prepared by adding 1.5 g of 1,2-bis(vinylsulfonylacetamidoethane) to 1,000 g of a 5% aqueous gelatin solution was applied as a protective layer thereon to have a wet thickness of 15 μm, and was dried to prepare Dye Fixing Element R-1.

Dye Fixing Elements R-2 to R-5 were prepared in the same manner as for Dye Fixing Element R-1, except that instead of the 5% aqueous gelation solution of the protective layer, oil dispersions (given in Table I) were used.

The oil dispersions were prepared as follows 10 cc of an aqueous 5% sodium dodecylbenzenesulfonate solution and 30 g of oil shown in Table I were added to 100 g of an aqueous 10% gelatin solution, the mixture was stirred at a high speed for 10 minutes by a mixer, and after adding 60 cc of water, the stirring was continued for a further 5 minutes. The thus-prepared dispersion is referred to as an oil dispersion.

The color photosensitive element thus prepared having a multilayer construction was exposed for 1 second using a tungsten lamp through G, R, IR (referring to green, red, and infrared, respectively) three color separation filters in which density changed continuously (G is a 500–600 nm band pass filter, R is a 600–700 nm band pass filter, and IR is a filter passing down to 700 nm) at 500 lux.

To the emulsion surface of each of the exposed photosensitive elements was supplied 13 ml/m$^2$ of water by a wire bar, and then the dye fixing element was superimposed thereon with the coated surfaces being in contact with each other.

Using a heat roller at a temperature being controlled such that the temperature of the coated layers absorbing water be 90° to 95° C., they are heated for 20 seconds, then the dye fixing element was peeled apart from the photosensitive element, and the peelability and the photographic performance were checked. The results are shown in Table I.

Method for Evaluating the Peelability

The peelability was evaluated by determining: (1) how much force was required to separate the elements, and (2) when the surface of the dye fixing element was observed after the peeling, if there was any come-off part of the coated layers, or any adhered part of the coated layers of the photosensitive element.

TABLE I

| Run No. | Photosensitive Element Sample No. | Oil | Added Amount (mg/m$^2$) | Dye Fixing Element Sample No. | Oil | $D_{max}$ C | M | Y | $D_{min}$ C | M | Y | Peelability |
|---|---|---|---|---|---|---|---|---|---|---|---|---|
| 1 | 101 | — | — | R-1 | — | — | — | — | — | — | — | could not peel |
| 2 | 101 | — | — | R-2 | (I-5) | 2.23 | 2.03 | 1.89 | 0.20 | 0.18 | 0.19 | could peel easily |
| 3 | 101 | — | — | R-3 | (I-4) | 2.25 | 2.07 | 1.90 | 0.19 | 0.18 | 0.18 | " |
| 4 | 101 | — | — | R-4 | (I-3) | 2.21 | 2.01 | 1.81 | 0.21 | 0.17 | 0.18 | " |
| 5 | 101 | — | — | R-5 | (I-10) | 2.19 | 2.00 | 1.79 | 0.19 | 0.16 | 0.16 | " |
| 6 | 102 | (I-14) | 200 | R-1 | — | 2.32 | 2.13 | 1.90 | 0.19 | 0.18 | 0.18 | " |

TABLE I-continued

| Run No. | Photosensitive Element Sample No. | Oil | Added Amount (mg/m²) | Dye Fixing Element Sample No. | Oil | $D_{max}$ C | M | Y | $D_{min}$ C | M | Y | Peelability |
|---|---|---|---|---|---|---|---|---|---|---|---|---|
| 7 | 103 | (I-30) | 100 | R-1 | — | 2.35 | 2.09 | 1.89 | 0.20 | 0.19 | 0.16 | " |
| 8 | 104 | (I-5) | 200 | R-1 | — | 2.28 | 2.08 | 1.85 | 0.18 | 0.18 | 0.18 | " |
| 9 | 105 | (I-5) | 150 | R-1 | — | 2.33 | 2.07 | 1.82 | 0.17 | 0.17 | 0.17 | " |
| 10 | 102 | (I-14) | 200 | R-2 | (I-5) | 2.28 | 2.04 | 1.83 | 0.18 | 0.16 | 0.18 | " |
| 11 | 102 | (I-14) | 200 | R-4 | (I-3) | 2.23 | 2.01 | 1.86 | 0.19 | 0.18 | 0.16 | " |

Note:
Amount of oil added to the dye fixing element: 100 mg/m²
Run No. 1 is a comparative example, and others are examples of the present invention.

As is clear from Table I, when the present photosensitive elements and/or dye fixing elements were used (Run Nos. 2 to 11), the dye fixing elements were peeled easily, the peeled surfaces were free from damage and stain, and clear images well high in the transferred density of the dye were obtained.

On the contrary, when Photosensitive Element 101 and Dye Fixing Element R-1 were used, the dye fixing element and the photosensitive element were adhered and were not peeled from each other, and when they were peeled forcibly, the coated layers came off, and a satisfactory image was not obtained.

EXAMPLE 2

Photosensitive Element 106 was prepared in the same manner as that for Photosensitive Element 101, except that the amount of the hardening agent (H agent) used in Photosensitive Element 101 prepared in Example 1 was changed to 12 wt % based on the total amount of the binder.

Photosensitive Elements 101 and 106 were exposed in the same manner as for Example 1. Then, after the photosensitive elements were dipped in water for 2 seconds, the water adhered to the surface was squeezed by a roller. Thus, the water content in the photosensitive element absorbing water was determined by weighing. The results are set forth in Table II. Photosensitive Elements 101 and 106 were superimposed on Dye Fixing Element R-1 and/or Dye Fixing Element R-2 with the coated surfaces in contact with each other, and heat development and transfer treatment were carried out in the same manner as for Example 1. The results are also set forth in Table II.

TABLE II

| Run No. | Photosensitive Element Sample No. | Amount of Added Hardening Agent* | Dye Fixing Element Sample No. | Oil | Water Content (g/m²) | $D_{max}$ Cyan | Magenta | Yellow | $D_{min}$ Cyan | Magenta | Yellow | Peelability** |
|---|---|---|---|---|---|---|---|---|---|---|---|---|
| 12 | 101 | 2 | R-1 | — | 14 | — | — | — | — | — | — | x |
| 13 | 101 | 2 | R-2 | (I-14) | 14 | 2.26 | 2.08 | 1.83 | 0.20 | 0.18 | 0.16 | o |
| 14 | 106 | 12 | R-1 | — | 7 | 1.78 | 1.63 | 1.41 | 0.18 | 0.16 | 0.14 | Δ |

*Amount of added hardening agent: wt % based on the amount of the binder
**x: Could not peel
Δ: Peeled but a part of the layer of the photosensitive element came off
o: Peeled easily
Run No. 13 is an example of the present invention, and the others are comparative examples.

As is clear from Table II, Photosensitive Element 106 wherein the amount of the hardening agent (12% to the total amount of the binder) was higher than Photosensitive Element 101 was improved in the peelability, but the transfer of the released dye to the dye fixing element is late due to the insufficient amount of water absorbed during the dipping in water for a short period of time (about 2 seconds). As a result, lowering of the dye transfer density occurred. In contrast, in the combination of Run No. 13 according to the present invention, peeling could be carried out easily, the peeled surface was neither damaged nor stained, and an enough transfer density was obtained.

EXAMPLE 3

Each oil dispersion was prepared as follows.

10 g of each compound shown in Table III has added to an aqueous 10% gelatin solution in which 0.5 g of succinic acid-2-ethylhexyl ester sulfonic acid sodium was dissolved and was dispersed at 40° to 50° C. for 10 minutes at 10,000 rpm by a homogenizer to obtain an oil dispersion.

Photosensitive Elements 301 to 304 were prepared in the same manner as for Photosensitive Element 101 in Example 1, except that a dispersion of each compound shown in Table III was added to the sixth layer (protective layer) of Photosensitive Element 101 in Example 1.

Dye Fixing Elements R-31 to R-34 were prepared in the same manner as for Dye Fixing Element R-1, except that in Dye Fixing Element R-1 in Example 1, a dispersion of each of compounds shown in Table III was used in the protective layer.

Photosensitive Elements 301 to 304 were exposed and supplied with water in the same manner as for Example 1, then were superimposed on Dye Fixing Elements R-31 to R-34, and were heat-treated, then the dye fixing element was peeled apart from the photosensitive element, and the peelability and the photographic performance were checked, with the results being set forth in Table III.

TABLE III

| Run No. | Photosensitive Element Sample No. | Oil | Amount of Oil ($g/m^2$) | Dye Fixing Element Sample No. | Oil | Amount of Oil ($g/m^2$) | $D_{max}$ Cyan | Magenta | Yellow | $D_{min}$ Cyan | Magenta | Yellow | Peel-ability* |
|---|---|---|---|---|---|---|---|---|---|---|---|---|---|
| 15 | 101 | — | — | R-1 | — | — | — | — | — | — | — | — | D |
| 16 | 301 | (I-5) | 0.3 | R-1 | — | — | 2.21 | 2.18 | 2.01 | 0.21 | 0.20 | 0.23 | B |
| 17 | 302 | (I-5) | 0.1 | R-1 | — | — | 2.13 | 2.09 | 1.98 | 0.19 | 0.17 | 0.21 | C |
| 18 | 303 | (I-14) | 0.1 | R-1 | — | — | 2.25 | 2.20 | 2.03 | 0.20 | 0.21 | 0.25 | B |
| 19 | 304 | (I-15) | 0.1 | R-1 | — | — | 2.30 | 2.24 | 2.11 | 0.23 | 0.22 | 0.24 | B |
| 20 | 101 | — | — | R-31 | (I-5) | 0.2 | 2.01 | 1.98 | 1.89 | 0.18 | 0.16 | 0.19 | B |
| 21 | 101 | — | — | R-32 | (I-5) | 0.05 | 2.24 | 2.19 | 2.02 | 0.21 | 0.19 | 0.20 | C |
| 22 | 101 | — | — | R-33 | (I-32) | 0.05 | 2.32 | 2.21 | 2.11 | 0.23 | 0.21 | 0.22 | B |
| 23 | 101 | — | — | R-34 | (I-15) | 0.05 | 2.31 | 2.25 | 2.04 | 0.21 | 0.18 | 0.21 | B |
| 24 | 302 | (I-5) | 0.1 | R-32 | (I-5) | 0.05 | 2.20 | 2.18 | 2.00 | 0.18 | 0.16 | 0.20 | C |
| 25 | 303 | (I-14) | 0.1 | R-33 | (I-32) | 0.05 | 2.37 | 2.27 | 2.14 | 0.22 | 0.20 | 0.21 | A |

*A: excellent, B: good, C: a part of the layer came off, D: could not peel
Run No. 15 is a comparative example, and the others are examples of the present invention.

As is clear from Table III, when Photosensitive Elements 303 and 304 containing Compounds (I-14) and (I-15) according to the present invention or Dye Fixing Elements R-33 and R-34 were used, the peeling was easy, the peeled surface was free from damage and stain and good in gloss, and an enough transfer density could be obtained. Particularly, the effect was remarkable when both the photosensitive element and the dye fixing element were contained. In the cases of Photosensitive Elements 301 and 302 or Dye Fixing Elements R-33 and R-34, when the amount was increased by 2 to 4 times of (I-14) or (I-15), sufficiently good peelability could be obtained, while when the amount was the same as (I-15) or (I-15), the peelability was not sufficient, and part of the peeled surface of the dye fixing element had part of the photosensitive element that had come off. This result shows that, of the silicone oils, particularly a silicone oil having —COOH groups has a remarkable effect, even if it is used in a small amount.

While the invention has been described in detail and with reference to specific embodiments thereof, it will be apparent to one skilled in the art that various changes and modifications can be made therein without departing from the spirit and scope thereof.

What is claimed is:

1. A method for forming an image comprising developing a photosensitive element which comprises a support provided thereon a photosensitive layer containing at least a photosensitive silver halide, a binder, and a dye providing substance which forms or releases a diffusible dye by developing after or simultaneously with imagewise exposure thereof, transferring the thus-formed or released diffusible dye to a dye fixing layer of a dye fixing element, and thereafter separating said photosensitive element and said dye fixing element from each other, the improvement wherein at least one non-photosensitive layer constituting said photosensitive element and said dye fixing element and which layer is present between said dye fixing layer and said photosensitive layer upon transferring said diffusible dye, and which constitutes a surface layer after said photosensitive element and said dye fixing element are separated contains an oil component.

2. A method for forming an image as in claim 1, wherein said photosensitive element is developed by heating.

3. A method for forming an image as in claim 1, wherein said photosensitive element and said dye fixing element are provided on different supports, and said at least one layer containing said oil component is a surface protective layer of at least one of said photosensitive element and said dye fixing element.

4. A method for forming an image as in claim 1, wherein said photosensitive element and said dye fixing element are provided on the same support, and said at least one layer containing said oil component is a peeling layer provided between said photosensitive layer and said dye fixing layer.

5. A method for forming an image as in claim 3, wherein said surface protective layer is the uppermost layer of at least one of said photosensitive element and said dye fixing element.

6. A method for forming an image as in claim 1, wherein said oil component is a high boiling point organic solvent having a boiling point of about 140° C. or higher.

7. A method for forming an image as in claim 1, wherein said oil component is a silicone oil.

8. A method for forming an image as in claim 7, wherein said oil component is a silicone oil having a carboxyl group.

9. A method for forming an image as in claim 7, wherein said oil component is a silicone oil represented by formula (I)

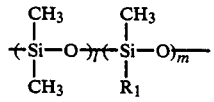

(I)

and has siloxane units represented by formula (I-1) and end groups represented by formula (I-2)

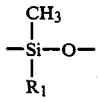

(I-1)

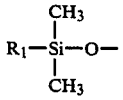

(I-2)

wherein $R_1$ represents a hydrogen atom, a substituted or unsubstituted alkyl group, a cycloalkyl group, a substituted or unsubstituted aryl group, a substituted or unsubstituted alkoxy group, or a substituted or unsubstitute alkoxycarbonyl group; represents an integer of 0, 1, or more than 1; and m represents an integer of 1 or more, provided that l+m represents an integer of from 1 to 1,000.

10. A method for forming an image as in claim 9, wherein l+m is an integer of from 2 to 500.

11. A method for forming an image as in claim 9, wherein said silicone oil is represented by formula (II) or (III)

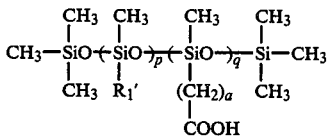

(II)

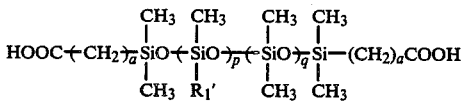

(III)

wherein $R_1'$ represents a hydrogen atom, a substituted or unsubstituted alkyl group, a cycloalkyl group, a substituted or unsubstituted aryl group, a substituted or unsubstituted alkoxy group, or a substituted or unsubstituted alkoxycarbonyl group; p represents an integer of 0, 1, or more than 1; q represents an integer of 1 or more; and a represents an integer of from 1 to 17.

12. A method for forming an image as in claim 11, wherein said silicone oil represented by formula (II) or (III) has a carboxyl equivalent of from 120 to 6,000.

13. A method for forming an image as in claim 12, wherein said silicone oil represented by formula (II) or (III) has a carboxyl equivalent of from 120 to 4,000.

14. A method for forming an image as in claim 1, wherein said oil component has a viscosity of from about 20 to about 100,000 centistokes at 25° C.

15. A method for forming an image as in claim 1, wherein the amount of said oil component in said non-photosensitive layer is such that the volume ratio thereof to a binder of said non-photosensitive layer is in the range of from about 0.005/1 to about 1/1.

16. A method for forming an image as in claim 1, wherein the amount of said oil component in said non-photosensitive layer is such that the volume ratio thereof to a binder of said non-photosensitive layer is in the range of from 0.01/1 to 0.4/1.

17. A method for forming an image as in claim 1, wherein said non-photosensitive layer containing said oil component comprises a hydrophilic binder.

18. A method for forming an image comprising developing a photosensitive element which comprises a support provided thereon a photosensitive layer containing at least a photosensitive silver halide, a binder, and a dye providing substance which forms or releases a diffusible dye by developing after or simultaneously with imagewise exposure thereof, transferring the thus-formed or released diffusible dye to a dye fixing layer of a dye fixing element, and thereafter separating said photosensitive element and said dye fixing element from each other, the improvement wherein at least one non-photosensitive layer constituting said photosensitive element and said dye fixing element contains a silicone oil component.

* * * * *